US008215807B1

(12) United States Patent
Brunesti

(10) Patent No.: US 8,215,807 B1
(45) Date of Patent: Jul. 10, 2012

(54) ILLUMINATING FLAGPOLE ASSEMBLY

(76) Inventor: Anthony C. Brunesti, Lakewood, CA (US)

( * ) Notice: Subject to any disclaimer, the term of this patent is extended or adjusted under 35 U.S.C. 154(b) by 22 days.

(21) Appl. No.: 12/788,888

(22) Filed: May 27, 2010

(51) Int. Cl.
*F21S 8/00* (2006.01)

(52) U.S. Cl. ..... 362/431; 362/800

(58) Field of Classification Search ..... 362/182, 362/183, 431
See application file for complete search history.

(56) References Cited

U.S. PATENT DOCUMENTS

| | | | |
|---|---|---|---|
| 3,752,975 | A | 8/1973 | Meyer |
| 4,281,369 | A | 7/1981 | Batte |
| 4,451,871 | A | 5/1984 | Kirkley et al. |
| D424,729 | S | 5/2000 | Sonnenfeldt |
| 6,060,658 | A | 5/2000 | Yoshida et al. |
| 6,227,683 | B1 | 5/2001 | Tukia |
| 6,455,767 | B1 | 9/2002 | Muller |
| 2005/0083693 | A1 | 4/2005 | Garrett |
| 2007/0220790 | A1 * | 9/2007 | Wagter ..... 40/218 |

* cited by examiner

*Primary Examiner* — Robert May
*Assistant Examiner* — Leah S Macchiarolo

(57) ABSTRACT

A flagpole and light combination assembly includes a pole having a top end. A light emitter is attached to the pole. A power source is electrically coupled to the light emitter and comprises a rechargeable battery mounted in the pole. A solar panel is electrically coupled to the rechargeable battery. The solar panel is mounted on the pole. A connecting apparatus releasably connects the flag to the pole and positions the flag adjacent to the light emitter. The light emitter is spaced from the top end of the pole to emit light laterally of the pole and onto the flag. The connecting apparatus includes an upper flag coupler and a lower flag coupler spaced from each other. The light emitter is positioned between the upper and lower flag couplers and emits light orthogonally to the pole to illuminate the flag.

5 Claims, 5 Drawing Sheets

ILLUMINATING FLAGPOLE ASSEMBLY

BACKGROUND OF THE DISCLOSURE

1. Field of the Invention

The present invention relates to flagpole devices and more particularly pertains to a new flagpole device for displaying an illuminating a flag.

2. Description of the Prior Art

The use of flagpole devices is known in the prior art. While these devices fulfill their respective, particular objectives and requirements, the need remains for a device that supports and illuminates a flag during periods of darkness. Further, the device should include a means of self-sustaining power.

SUMMARY OF THE INVENTION

The present invention meets the needs presented above by generally comprising a pole having a top end. A light emitter is attached to the pole. A power source is electrically coupled to the light emitter and comprises at least one rechargeable battery mounted in the pole. A solar panel is electrically coupled to the power source and converts light into electricity to recharge the at least one rechargeable battery. The solar panel is mounted on the pole. A connecting apparatus releasably connects the flag to the pole and positions the flag adjacent to the light emitter. The light emitter is spaced from the top end of the pole to emit light laterally of the pole and onto the flag. The connecting apparatus includes an upper flag coupler and a lower flag coupler spaced from each other. The light emitter is positioned between the upper and lower flag couplers and emits light orthogonally to the pole to illuminate the flag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
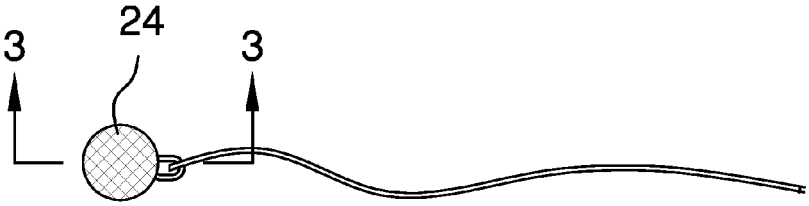
FIG. 2 is a top view of the present invention.

With reference now to the drawings, and in particular to FIGS. 1 through 8 thereof, a new flagpole device embodying the principles and concepts of the present invention and generally designated by the reference numeral 10 will be described.

As best illustrated in FIGS. 1 through 8, the flag 60 illuminating flagpole assembly 10 generally comprises a pole 12 that has a top end 14. A light emitter 16 is attached to the pole 12. The light emitter 16 is positioned within the pole 12 and the pole 12 has an opening 18 therein to allow light to be emitted outwardly of the pole 12 by the light emitter 16. The opening 18 is vertically elongated and is positioned adjacent to the top end 14. The light emitter 16 is also vertically elongated. It is preferred that the opening 18 has a height comparable to the height of a flag 60 to be displayed on the pole 12.

A transparent covering 20 is positioned over the opening 18. The covering 20 comprises a lens to amplify light emitted by the light emitter 16. The lens, or covering 20, may also be used to diffuse the light to ensure that the flag 60 is illuminated as it moves with respect to the pole 12.

Figure 1:
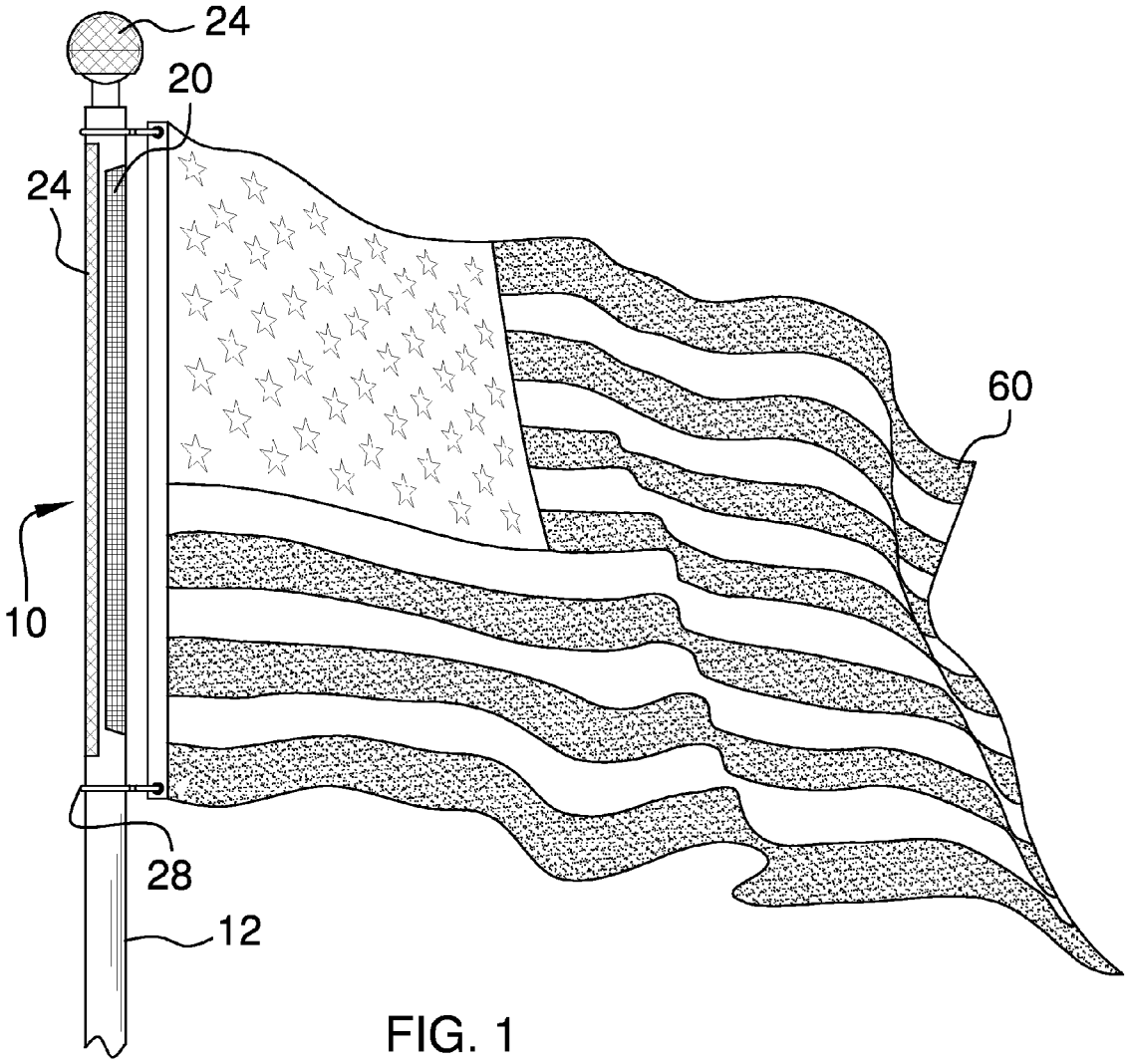
FIG. 1 is a side-in use view of a flag illuminating flagpole assembly according to the present invention.
Figure 3:
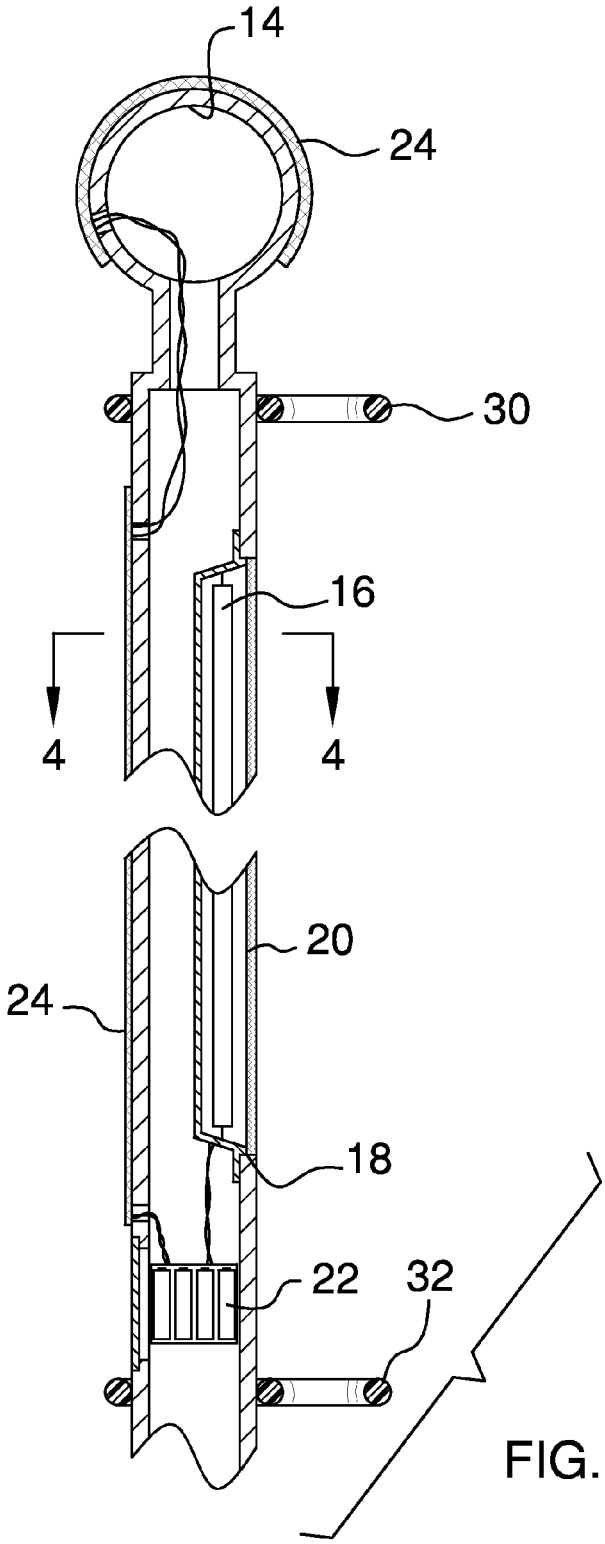
FIG. 3 is a cross-sectional view taken along line 3-3 of FIG. 2 of the present invention.
Figure 4:
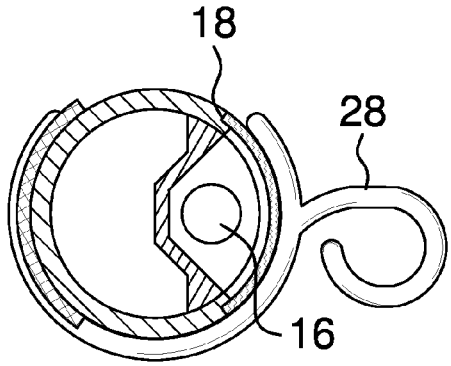
FIG. 4 is a cross-sectional view taken along line 4-4 of FIG. 3 of the present invention.
Figure 6:
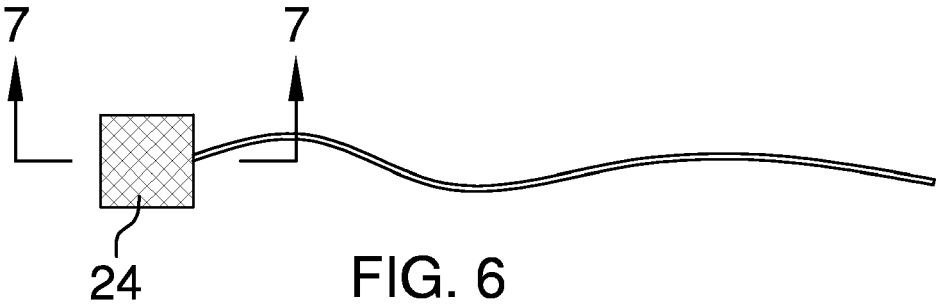
FIG. 6 is a top view of the second embodiment of the present invention.
Figure 5:
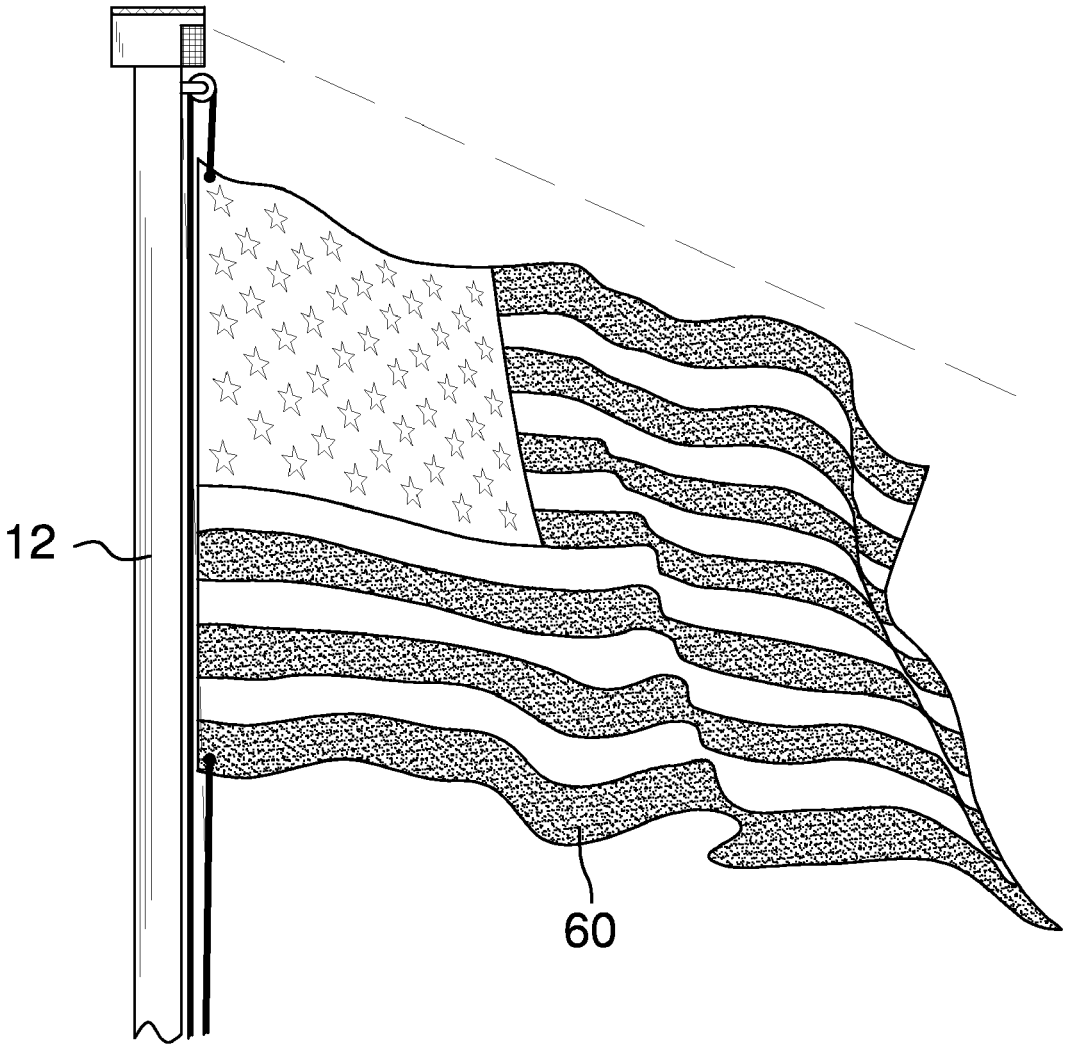
FIG. 5 is a side view of a second embodiment of the present invention.
Figure 7:
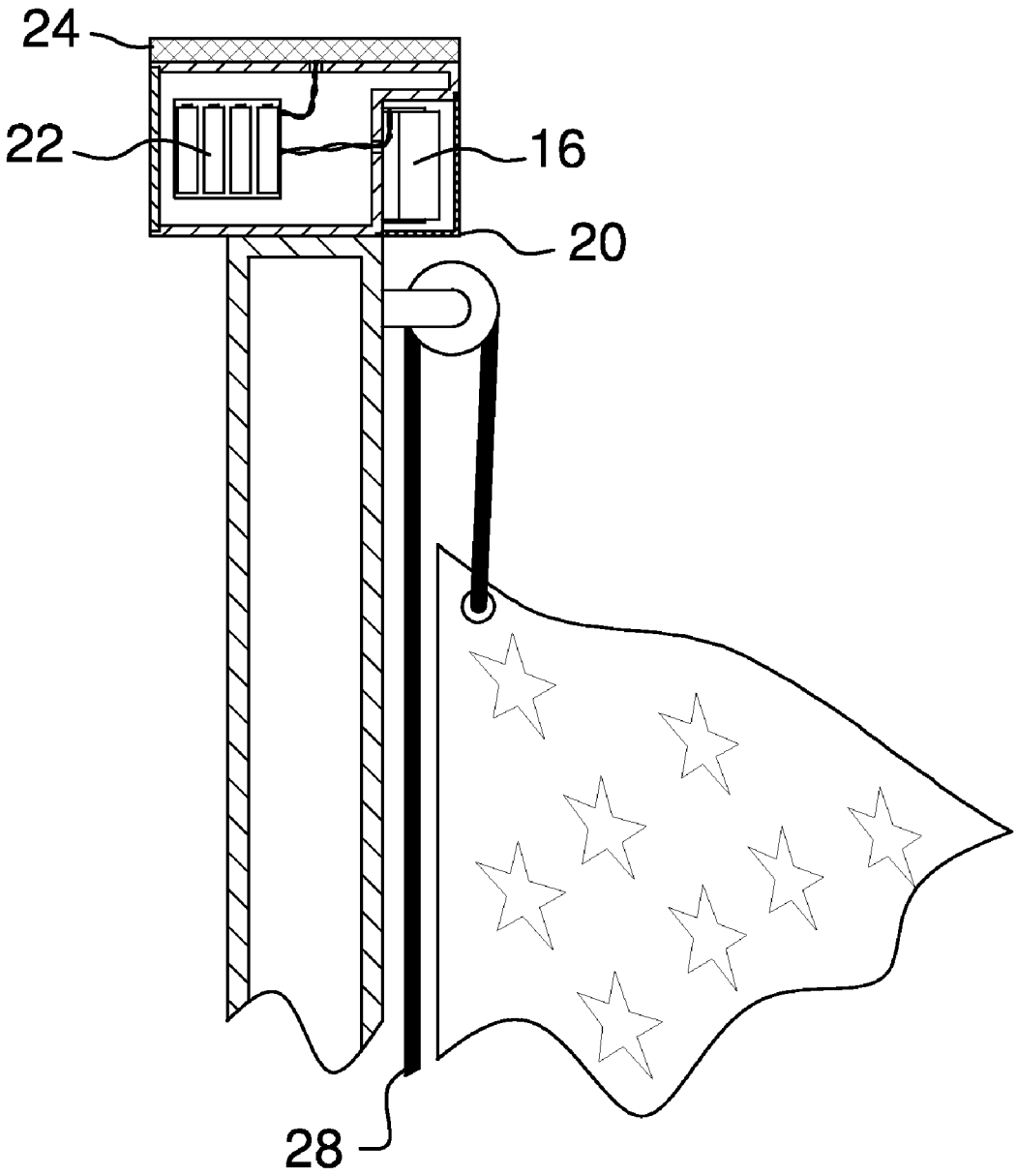
FIG. 7 is a cross-sectional view taken along line 7-7 of FIG. 6 of the present invention.
Figure 8:
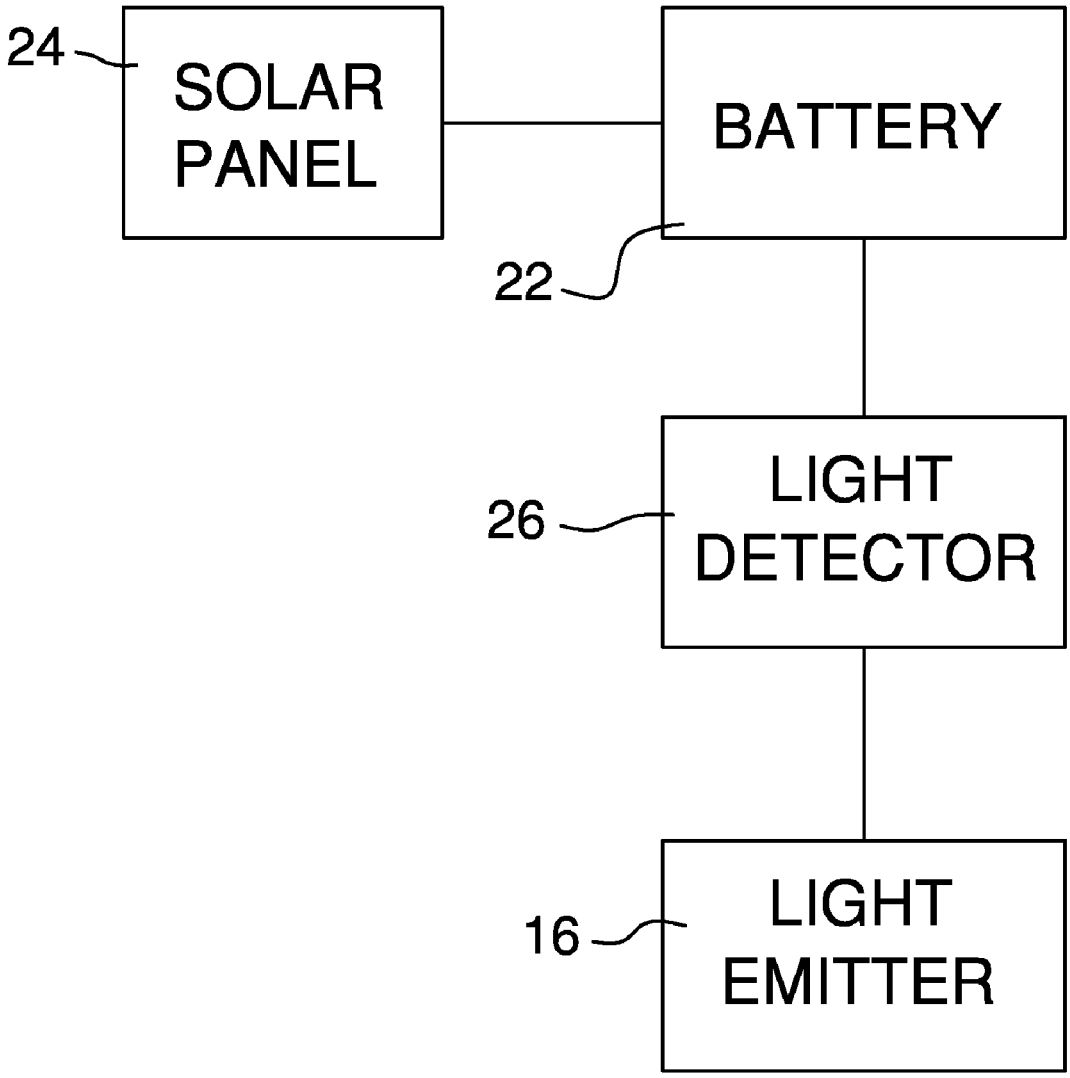
FIG. 8 is a schematic view of the present invention.

A power source 22 is electrically coupled to the light emitter. The power source 22 comprises at least one rechargeable battery mounted in the pole. A solar panel 24 is electrically coupled to the power source 22 and converts light into electricity to recharge the at least one rechargeable battery. The solar panel 24 is mounted on the pole 12. As shown in FIGS. 1-3, the solar panel 24 may include a plurality of solar panels with one of the solar panels 24 mounted on the top end 14. As shown in FIGS. 5-7, the solar panel 24 and the light emitter 16 may both be mounted on the top end 14. In this version, the light emitter 16 shines light downwardly onto the flag 60. A light detector 26 is electrically coupled to the power source 22. The light detector 26 closes a connection between the power source 22 and the light emitter 16 when the light detector 26 detects an absence of sunlight to turn the light emitter 16 on.

A connecting apparatus 28 releasably connects the flag 60 to the pole 12 and positions the flag 60 adjacent to the light emitter 16. The connecting apparatus 28 is conventional and may include clips alone that attach the flag 60 to the pole 12, as could be used with a pole for a residence, or the connecting apparatus 60 may include a rope and pulley system for allowing the lowering and lifting of the flag 60.

The connecting apparatus 28, of the embodiment shown in 1-3, includes an upper flag coupler 30 and a lower flag coupler 32 spaced from each other, wherein the light emitter 16 of that embodiment is positioned between the upper 30 and lower 32 flag couplers. The lower 32 and upper 30 flag couplers may be any conventional flag coupler, such as a clip, and may be mounted on a tether. The upper flag coupler 30 is defined as the coupler positioned nearest to the top end 14 of the flagpole 12 when the upper 30 and lower 32 flag coupler are at their highest position on the flagpole 12. This positioning causes the light emitter to emit light orthogonally to the pole 12 to illuminate the flag 60 when it is extended as shown in FIG. 1. This direction of emission will ensure that the flag 60 is fully illuminated along its length. The light emitter 20, though only shown in one place on the pole 12, may be extended completely around the pole 12.

In use, the pole 12 is used in a conventional manner to display a flag 60. However, the light emitter 16 will shine light on the flag 60 to illuminate the flag 60 to allow its viewing at night. The solar panel 24 ensures that the light emitter 16 will be powered without having to rely on an outside power source.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A flag displaying system including:

a flag having a rectangular shape, said flag first upper corner, a second upper corner, a first lower corner and a second lower corner, said first upper corner being positioned vertically above said first lower corner;

a pole having a top end;

a light emitter being attached to said pole;

a power source being electrically coupled to said light emitter, said power source comprising at least one rechargeable battery mounted in said pole;

a solar panel being electrically coupled to said power source and converting light into electricity to recharge said at least one rechargeable battery, said solar panel being mounted on said pole; and a connecting apparatus releasably connecting the flag to said pole and positioning said flag adjacent to said light emitter, said connecting apparatus being coupled to said flag at only at a first point and a second point, said first point being adjacent to said first upper corner and said second point being adjacent to said first lower corner; and said light emitter being spaced from said top end of said pole to emit light laterally of said pole and onto said flag, said connecting apparatus including an upper flag coupler and a lower flag coupler spaced from each other, said light emitter being positioned between said upper and lower flag couplers and emitting light orthogonally to said pole.

2. The system according to claim 1, wherein said light emitter is positioned within said pole, said pole having an opening therein to allow light to be emitted outwardly of said pole by said light emitter.

3. The assembly according to claim 2, wherein said opening is vertically elongated and is positioned adjacent to said top end, said light emitter being vertically elongated.

4. The assembly according to claim 2, further including a transparent covering being positioned over said opening, said covering comprising a lens, said lens amplifying and dispersing light emitted by said light emitter.

5. The assembly according to claim 1, further including a light detector being electrically coupled to said power source, said light detector closing a connection between said power source and said light emitter when said light detector detects an absence of sunlight.

* * * * *